US007262711B2

(12) United States Patent
Zhu et al.

(10) Patent No.: US 7,262,711 B2
(45) Date of Patent: Aug. 28, 2007

(54) EXTERNAL INDICATOR FOR ELECTRONIC TOLL COMMUNICATIONS

(75) Inventors: Jeffrey Zhu, Richmond Hill (CA); Wai-Cheung Tang, Mannheim (CA)

(73) Assignee: Mark IV Industries Corp., Ontario (CA)

( * ) Notice: Subject to any disclaimer, the term of this patent is extended or adjusted under 35 U.S.C. 154(b) by 157 days.

(21) Appl. No.: 10/969,036

(22) Filed: Oct. 20, 2004

(65) Prior Publication Data

US 2006/0082470 A1 Apr. 20, 2006

(51) Int. Cl.
*G08G 1/00* (2006.01)

(52) U.S. Cl. ..... 340/928; 235/384; 705/13

(58) Field of Classification Search ..... 340/928, 340/933, 10.3, 965; 235/380, 384; 701/117; 705/13

See application file for complete search history.

(56) References Cited

U.S. PATENT DOCUMENTS

| | | | | |
|---|---|---|---|---|
| 4,104,630 | A | | 8/1978 | Chasek |
| 4,303,904 | A | | 12/1981 | Chasek |
| 4,870,419 | A | | 9/1989 | Baldwin et al. |
| 4,937,581 | A | | 6/1990 | Baldwin et al. |
| 5,086,389 | A | | 2/1992 | Hassett et al. |
| 5,132,687 | A | | 7/1992 | Baldwin et al. |
| 5,144,553 | A | | 9/1992 | Hassett et al. |
| 5,164,732 | A | | 11/1992 | Brockelsby et al. |
| 5,196,846 | A | | 3/1993 | Brockelsby et al. |
| 5,253,162 | A | | 10/1993 | Hassett et al. |
| 5,266,947 | A | | 11/1993 | Fujiwara et al. |
| 5,289,183 | A | | 2/1994 | Hassett et al. |
| 5,310,999 | A | | 5/1994 | Claus et al. |
| 5,351,187 | A | | 9/1994 | Hassett |
| 5,424,727 | A | | 6/1995 | Shieh |
| 5,425,032 | A | | 6/1995 | Shloss et al. |
| 5,485,520 | A | | 1/1996 | Chaum et al. |
| 5,602,375 | A | | 2/1997 | Sunahara et al. |
| 5,640,156 | A | | 6/1997 | Okuda et al. |
| 5,657,008 | A | | 8/1997 | Bantli |
| 5,675,342 | A | * | 10/1997 | Sharpe ..... 340/10.2 |
| 5,701,127 | A | | 12/1997 | Sharpe |

(Continued)

FOREIGN PATENT DOCUMENTS

| | | |
|---|---|---|
| EP | 0 333 679 | 9/1989 |

(Continued)

OTHER PUBLICATIONS

U.S. Appl. No. 11/409,741, filed Apr. 24, 2006, Woo et al.

(Continued)

*Primary Examiner*—Brent A. Swarthout
(74) *Attorney, Agent, or Firm*—Hanley, Flight & Zimmerman, LLC

(57) ABSTRACT

An external indicator for use in proximity to an on-board unit or transponder for an electronic toll collection (ETC) system. The external indicator senses RF transmissions from the on-board unit and/or roadside readers of the ETC system and produces sensory outputs when transmissions are detected. The external indicator receives RF signals, demodulates them, and analyses the demodulated RF signals to determine if it has received a roadside reader trigger signal and/or a transponder response signal. A sensory indicator, such as a visual, auditory, or kinetic device, alerts an occupant of a vehicle to the detected RF transmissions and, accordingly, to the likely occurrence of an ETC transaction.

18 Claims, 3 Drawing Sheets

U.S. PATENT DOCUMENTS

| | | | | |
|---|---|---|---|---|
| 5,748,106 | A | 5/1998 | Schoenian et al. | |
| 5,751,973 | A | 5/1998 | Hassett | |
| 5,771,021 | A | 6/1998 | Veghte et al. | |
| 5,777,565 | A | 7/1998 | Hayashi et al. | |
| 5,805,082 | A | 9/1998 | Hassett | |
| 5,819,234 | A | 10/1998 | Slavin et al. | |
| 5,831,547 | A | 11/1998 | Ohtsuki et al. | |
| 5,841,866 | A | 11/1998 | Bruwer et al. | |
| 5,850,191 | A | 12/1998 | Yagi et al. | |
| 5,857,152 | A | 1/1999 | Everett | |
| 5,859,415 | A | 1/1999 | Blomqvist et al. | |
| 5,940,006 | A | 8/1999 | MacLellan et al. | |
| 5,963,149 | A | 10/1999 | Nagura et al. | |
| 6,025,799 | A | 2/2000 | Ho et al. | |
| 6,085,805 | A | 7/2000 | Bates | |
| 6,121,880 | A | 9/2000 | Scott et al. | |
| 6,191,705 | B1 | 2/2001 | Oomen et al. | |
| 6,219,613 | B1 | 4/2001 | Terrier et al. | |
| 6,339,384 | B1 * | 1/2002 | Valdes-Rodriguez | 340/928 |
| 6,344,804 | B1 * | 2/2002 | Koga | 340/928 |
| 6,356,207 | B1 * | 3/2002 | Oouchi | 340/928 |
| 6,616,034 | B2 | 9/2003 | Wu et al. | |
| 6,653,946 | B1 * | 11/2003 | Hassett | 340/928 |
| 6,661,352 | B2 | 12/2003 | Tiernay et al. | |
| 6,725,014 | B1 | 4/2004 | Voegele | |
| 6,898,753 | B2 | 5/2005 | Bonifas | |
| 2001/0050922 | A1 | 12/2001 | Tiernay et al. | |
| 2006/0071816 | A1 | 4/2006 | Tang et al. | |

FOREIGN PATENT DOCUMENTS

| | | |
|---|---|---|
| JP | 10-105753 | 4/1998 |
| WO | WO/9933027 | 1/1999 |

OTHER PUBLICATIONS

U.S. Appl. No. 11/409,897, filed Apr. 24, 2006, Woo et al.
U.S. Appl. No. 11/437,236, filed May 19, 2006, Tang et al.
U.S. Appl. No. 11/388,737, filed Mar. 24, 2006, Ho et al.
U.S. Appl. No. 11/284,277, filed Nov. 21, 2005, Tang et al.
U.S. Appl. No. 11/176,758, filed Jul. 7, 2005, Ho et al.
U.S. Appl. No. 11/054,520, filed Feb. 9, 2005, Tang.
U.S. Appl. No. 11/098,257, filed Apr. 4, 2005, Zhu.
U.S. Appl. No. 11/176,758, Wu.
Ching et al., *A Laser Micromachined Multi-Modal Resonating Power Transducer for Wireless Sensing Systems*, Sensors and Actuators A 97-98 (2002) 685-690, http://www.elsevier.com.
Finkenzeller, Klaus, *Ch. 3: Fundamental Operating Principles, RFID Handbook: Fundamentals and Applications in Contactless Smart Cards and Identification*, Klaus Finkenzellar, (2003) John Wiley & Sons, Ltd. ISBN 0-470-84402-7.
Sorrells, *Passive RFID Basics*, AN680, Michrochip Technology Inc., (1998) DS00680B.

* cited by examiner

EXTERNAL INDICATOR FOR ELECTRONIC TOLL COMMUNICATIONS

FIELD OF THE INVENTION

The present invention relates to radio frequency (RF) electronic toll collection and, in particular, to an external device for signalling occurrence of an electronic toll communication.

BACKGROUND OF THE INVENTION

Electronic toll collection systems conduct toll transactions electronically using RF communications between a vehicle-mounted transponder (a "tag") and a stationary toll plaza transceiver (a "reader"). A reader is sometimes referred to as a roadside unit (RSU) and a tag is sometimes referred to as an on-board unit (OBU). An example of an electronic toll collection system is described in U.S. Pat. No. 6,661,352 issued Dec. 9, 2003 to Tiernay et al., and owned in common with the present application. The contents of U.S. Pat. No. 6,661,352 are hereby incorporated by reference.

In a typical electronic toll collection system, the reader broadcasts a wakeup or trigger RF signal. A tag on a vehicle passing through the broadcast area or zone detects the wakeup or trigger signal and responds with its own RF signal. There are generally two types of tags: active transponders that generate and send their own signal and backscatter transponders that modulate a continuous wave signal provided by the reader. In either case, the tag responds by sending a response signal containing information stored in memory in the transponder, such as the transponder ID number, the last toll plaza ID number, etc. The reader receives the response signal and conducts an electronic toll transaction, such as by debiting a user account associated with the transponder ID number. The reader may then broadcast a programming RF signal to the tag. The programming signal provides the tag with updated information for storage in its memory. It may, for example, provide the tag with a new account balance and/or a new toll plaza ID number.

Some existing electronic toll collection systems feature relatively simple on-board units (tags) that have no sensory indicators, such as lights, display screens, speakers, or other sensory devices. Accordingly, a vehicle occupant cannot know whether or not his or her on-board unit is functioning correctly. In particular, as the vehicle passes through a toll collection plaza or zone the vehicle occupant may receive no indication as to whether a toll transaction has taken place.

It would be advantageous to provide for a device that may be used in conjunction with existing electronic toll collection system tags to signal occurrence of an electronic toll communication.

SUMMARY OF THE INVENTION

The present invention provides an external indicator for use in proximity to an on-board unit or transponder for an electronic toll collection (ETC) system. The external indicator senses RF transmissions from the on-board unit and/or roadside readers of the ETC system and produces sensory outputs when transmissions are detected. The external indicator receives RF signals, demodulates them, and analyses the demodulated RF signals to determine if it has received a roadside reader trigger signal and/or a transponder response signal. A sensory indicator, such as a visual, auditory, or kinetic device, alerts an occupant of a vehicle to the detected RF transmissions and, accordingly, to the likely occurrence of an ETC transaction.

In one aspect, the present invention provides external indicator for use in proximity to an on-board unit of an electronic toll collection system, the electronic toll collection system including a roadside unit for communicating with the on-board unit and conducting an electronic toll collection (ETC) transaction. The external indicator includes an RF antenna and an RF detector coupled to the RF antenna for demodulating an RF signal induced in the RF antenna by an RF transmission and for outputting a demodulated signal. It also includes a processor having an input for receiving the demodulated signal and an output for providing an indicator signal, the processor having a component for determining if the demodulated signal is indicative of an ETC transmission between the on-board unit and the roadside unit and, if so, generating the indicator signal. The external indicator includes an indicator device coupled to the output of the processor, the indicator device producing a sensory event in response to the indicator signal.

In another aspect, the present invention provides a method of signalling detection of a likely electronic toll collection (ETC) transaction between an on-board unit and a roadside unit. The method includes the steps of receiving and demodulating an RF signal to produce a demodulated signal, determining if the demodulated signal is indicative of an ETC transmission between the roadside unit and the on-board unit and, if so, generating an indicator signal, and outputting the indicator signal to an indicator device for producing an sensory event in response to the indicator signal.

Other aspects and features of the present invention will be apparent to those of ordinary skill in the art from a review of the following detailed description when considered in conjunction with the drawings.

BRIEF DESCRIPTION OF THE DRAWINGS

Reference will now be made, by way of example, to the accompanying drawings which show an embodiment of the present invention, and in which.

Similar reference numerals are used in different figures to denote similar components.

DESCRIPTION OF SPECIFIC EMBODIMENTS

Some of the embodiments described below relate to "open road" electronic toll collection systems, wherein vehicles are not gated through a toll plaza. It will be appreciated that the present invention may be used in conjunction with such electronic toll collection systems and with other electronic toll collection systems, including lane-based toll booth systems. Moreover, it will be appreciated that the present invention is not restricted to highway toll payment, but rather may be used in conjunction with other electronic payment systems employing vehicle-borne transponders and external stationary readers, such as electronic parking collection systems.

Figure 1:
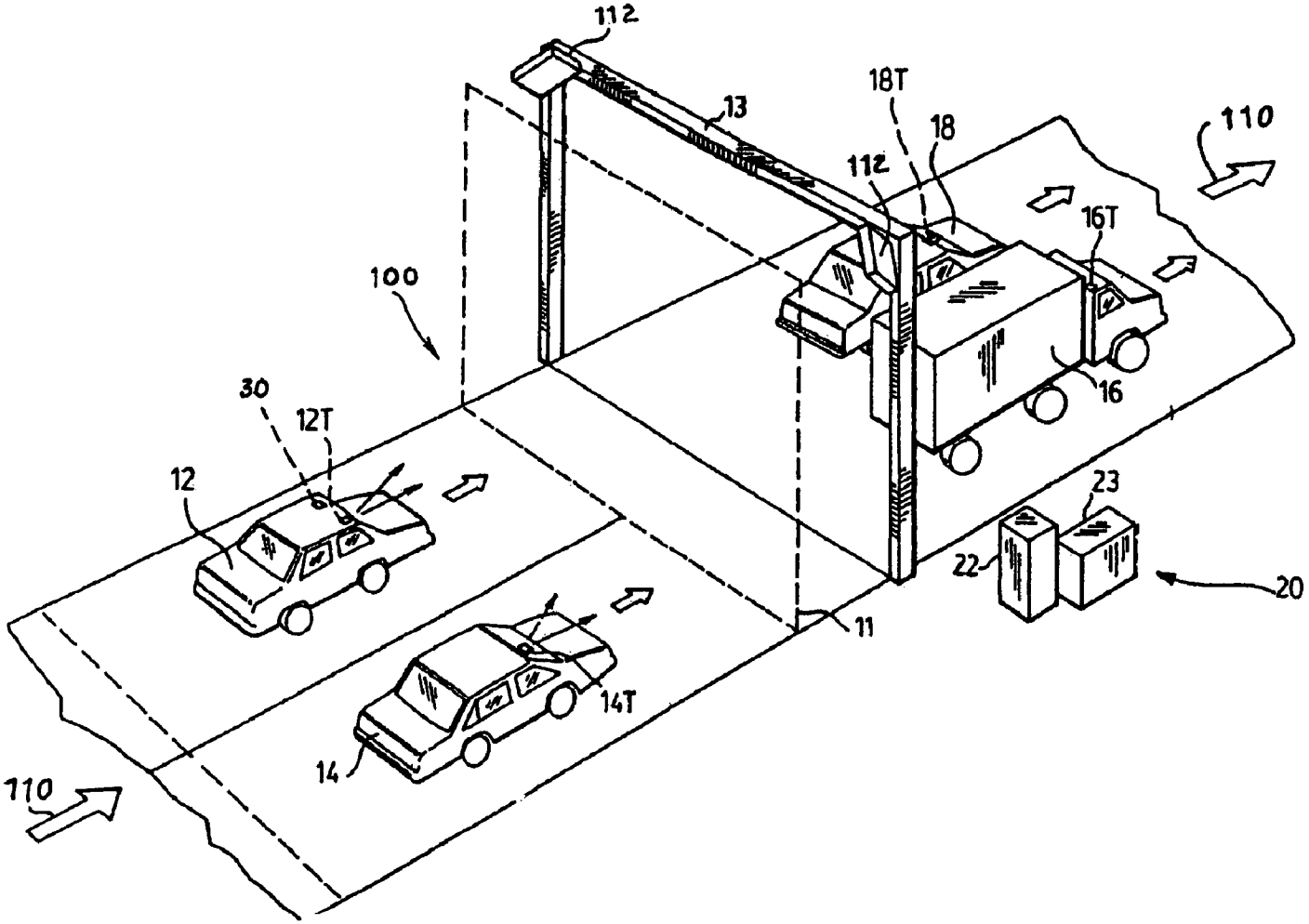
FIG. 1 shows a perspective view of an extent of toll highway having an electronic toll collection system.

Reference is first made to FIG. 1, which shows an extent of toll highway which represents a communication zone 100 having a downstream direction indicated by arrows 110. At a point which corresponds to an entrance or an exit point from the highway, tolling equipment is provided comprising a photography gantry 11 and, just downstream therefrom, a radio frequency (RF) toll gantry 13 with antennae 112 thereon.

Motor vehicles 12 and 14 are shown approaching the gantries 11, 13 and motor vehicles 16 and 18 are shown having just passed the gantries 11, 13.

A roadside RF system 20 includes a processor 23 which includes the means for coordinating a reader 22, Application Processing (not shown), Angle of Arrival Processor (not shown), their interfaces and data links. The reader 22 communicates with motor vehicle-borne transponders by means of the gantry antennae 112. Such motor vehicle-borne transponders are shown as 12T, 14T, 16T, and 18T.

The protocol for communication between said transponders 12T, 14T, 16T, and 18T and the reader 22 is a two-way RF communications system, forming part of an electronic toll collection system. The RF signals used are normally about 915 MHz and signal at a data bit rate of about 500 kbps. The roadside RF system 20 is part of the electronic toll collection system.

The roadside RF system 20 and the RF toll gantry 13 output a wakeup (or trigger) signal which will activate a transponder circuit within the communications zone 100. Each transponder will attempt to activate into one of several activation time slots at random. The reader 22 and the communications protocol will ensure that each communication with the transponders 12T, 14T, 16T, and 18T is in a different time slot. The reader 22 continuously polls for transponders that have not previously communicated or have just entered the zone 100. In another embodiment, the toll gantry 13 is limited in power and range and is disposed so as to ensure only one vehicle is within range of the toll gantry 13 at one time, thereby eliminating the need for a time division multiplexing communication protocol. Other embodiments of an electronic toll highway system will be apparent to those of ordinary skill in the art.

The communication protocol will customarily cause the transponders 12T, 14T, 16T, and 18T to communicate specific data carried in memory. The data includes characteristics, such as the transponder identification code, class type (e.g. standard, commercial, recreational), last entry/exit point and, in some applications, account status or balance and battery condition.

At least one of the motor vehicles, for example motor vehicle 12, is equipped with a transponder 12T that does not includes any sensory indicators to signal to the driver that an electronic toll transaction has occurred or is occurring. Accordingly, the motor vehicle 12 includes an external indicator 30. The external indicator 30 is placed in close proximity to the transponder 12T. In some embodiments, the external indicator 30 may be provided with a sticky backing or other mechanism for affixing the external indicator 30 to the interior of the windshield in close proximity to the transponder 12T. In another embodiment, the external indicator 30 includes a chain, hook or other mechanism for hanging the external indicator 30 from, for example, the rear-view mirror of the motor vehicle 12. In yet another embodiment, the external indicator 30 includes a bracket, sticky pad, or other mechanism for affixing the external indicator 30 to the dashboard of a vehicle. Other mechanisms for placing the external indicator 30 in relatively close proximity to a transponder will be apparent to those of ordinary skill in the art.

The external indicator 30 detects RF transmissions between the transponder 12T and the reader 22 or, more particularly, the gantry-mounted antennae 112. The external indicator 30 includes a sensory output device for signalling to an occupant of the motor vehicle 12 that an RF transmission has been detected. In this manner, the vehicle occupant is notified that the transponder 12T is engaged in communications with the reader 22. The occupant may conclude that an electronic toll collection (ETC) transaction is being processed by the roadside RF system 20.

The sensory output produced by the external indicator 30 may take any form suitable for notifying an occupant of the vehicle that RF transmissions have been detected. For example, the external indicator 30 may include a visual indicator, such as one or more light emitting diodes (LEDs). It may also, or alternatively, include an auditory indicator, such as a buzzer, chimes, speaker, or other auditory device. In some embodiments, the sensory output may be kinetic, such as through a vibratory mechanism. Different sensory outputs may be used in combination.

In some embodiments, the external indicator 30 may be coupled to the motor vehicle 12 on-board electronics such that it sends an indicator signal to the motor vehicle 12 systems and the sensory output is generated by the motor vehicle 12 system. For example, the motor vehicle 12 dashboard display may provide an indicator light or sound in response to the indicator signal. Other methods of signalling the vehicle occupant will be apparent to one of ordinary skill in the art.

Embodiments of the external indicator 30 may be adapted to detect RF ETC communications with varying degrees of specificity. In one embodiment, the external indicator 30 detects the RF wakeup signal broadcast by the reader 22. In this embodiment, the external indicator 30 produces an indicator signal whenever the external indicator 30 enters the communications zone 100 where the reader 22 is broadcasting the RF wakeup signal.

In another embodiment, the external indicator 30 detects the RF wakeup signal broadcast by the reader 22 and compares the detected RF signal to a predetermined pattern to confirm that the signal is in fact an ETC wakeup signal and not an RF signal relating to another type of system. For example, if RF wakeup signal is characterized by a transmission having a predefined duration, then the external indicator may assess whether the detected signal features the predefined duration. In another example, if the RF wakeup signal is characterized by a particular set of pulses (or a pattern) at a given frequency, then the external indicator 30 assesses whether the detected signal matches the expected set of pulses (or pattern).

In a further embodiment, the external indicator 30 detects the RF wakeup signal broadcast by the reader 22 and awaits a response signal from the transponder 12T. If the external indicator 30 detects a response signal from the transponder 12T, then it generates the indicator signal to signify that an ETC communication has been detected and that an ETC transaction is likely taking place. In such an embodiment, the external indicator 30 may detect the response signal on the basis of a comparison of the detected response signal with a predetermined response signal pattern to verify that the detected signal is a legitimate transponder response signal. For example, the external indicator 30 may compare the duration of the detected response signal with a predefined expected duration for a legitimate response signal.

In another example, the external indicator 30 may compare the coding scheme of the detected response signal with the predefined coding scheme associated with a legitimate transponder response signal, such as Manchester encoding. In yet another example, the external indicator 30 may compare the data contents or a portion of the contents of the detected response signal with a predetermined pattern or result, such as a check code, an ID number format, or other expected and verifiable content.

Those of ordinary skill in the art will appreciate that detecting the response signal from the transponder 12T is preferable to simply detecting the wakeup signal from the reader 22 since the response signal at least indicates that the transponder 12T is communicating with the reader 22. In an embodiment wherein only the wakeup signal is detected, the external indicator 30 only indicates when a reader is in the vicinity, and not whether the transponder is communicating with the reader. To provide a device that indicates to a driver that an ETC transaction has occurred, it is preferable that the external indicator 30 detect the response signal from the transponder. The external indicator 30 could be designed to detect a subsequent programming signal from the reader; however, the external indicator 30 would need to be able to distinguish between a programming signal broadcast to its associated transponder 12T as opposed to a transponder in another vehicle in the communications zone 100.

In some embodiments, the external indicator 30 may provide a sensory indication corresponding to detection of a reader trigger signal and a different sensory indication corresponding to detection of a transponder response signal. For example, upon detecting a reader trigger signal, the external indicator may begin flashing a yellow LED to signal that the vehicle has entered a toll collection area. Once a transponder response signal is detected, the external indicator may illuminate a green LED to indicate that the transponder has responded and that an ETC transaction has likely occurred.

In order to conserve power and battery life, the external indicator 30 may operate in a low-current sleep mode until it receives the wakeup signal from the reader 22. Thereafter it powers-up and attempts to detect the response signal from the transponder. Once the external indicator 30 detects the response signal and triggers the sensory indicator, or once the external indicator 30 fails to detect a response signal and times out, then it re-enters the low-current sleep mode to await receipt of a further wake-up signal. To avoid being re-triggered in the same toll plaza, the external indicator 30 may include a timer component for ignoring wakeup signals for a predetermined duration after triggering a sensory indicator or timing out without detecting a response signal. In another embodiment, the external indicator 30 may examine the contents of any detected signals to determine whether the signals relate to the same transaction or the same toll plaza. For example, the external indicator 30 may examine any communications from the reader to determine if the reader ID is the same as was previously received. If so, the external indicator 30 may conclude that it is in the same toll plaza. Alternatively, the external indicator 30 may examine the contents of any detected transponder response signals to determine whether it is in the same toll plaza. For example, it may examine the last transaction field in the response signal to see if the data remains the same.

Figure 2:
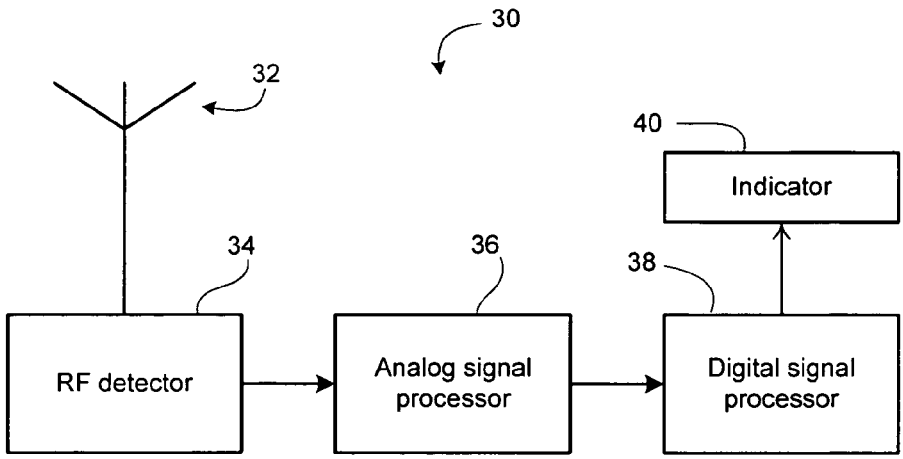
FIG. 2 shows a block diagram of an external indicator.

Reference is now made to FIG. 2, which shows a block diagram of the external indicator 30. The external indicator 30 includes an RF antenna 32 and an RF detector 34 coupled to the RF antenna 32. A current is induced in the RF antenna 32 by a received RF signal. The RF detector 34 demodulates the received signal and outputs a baseband (i.e. demodulated) signal.

The external indicator 30 further includes an analog signal processor 36, a digital signal processor 38, and an indicator device 40. The analog signal processor 36 receives the baseband signal from the RF detector 34. The analog signal processor 36 may include a comparator component for performing signal strength threshold detection. It also may include signal conditioning or shaping components for removing or compensating for anomalies introduced by the channel and/or for shaping the analog signal into a digital signal.

The analog signal processor 36 outputs a detected signal. The detected signal is input to the digital signal processor 38. In one embodiment, the analog signal processor 36 performs signal shaping to convert the baseband analog signal to a digital received signal, which is input to the digital signal processor 38. The digital signal processor 38 then analyzes the digital received signal to determine if the received signal features certain required characteristics. For example, the digital signal processor 38 may attempt to locate a predetermined bit pattern that is expected in a transponder response signal. Successful detection of a qualifying signal is achieved if the digital signal processor 38 determines that the received signal has the required characteristics. The digital signal processor 38 has an output connected so as to trigger the indicator device 40 once the qualifying signal is detected. It will be understood that the particular characteristics that will be indicative of a transponder response signal are dependent upon the communications protocol of the particular ETC system.

As described above, the indicator device 40 may include auditory, visual, or kinetic signalling devices. In one embodiment, the indicator device 40 includes one or more lights. In another embodiment, the indicator device 40 includes a buzzer. Other variations will be apparent to those skilled in the art.

Those of ordinary skill in the art will appreciate that various functions described as being performed by the analog signal processor 36 may, in other embodiments, be performed by the digital signal processor 38. Similarly, in some embodiments functions described as being performed by the digital signal processor 38 may be implemented as analog signal processing. In some embodiments, either the analog signal processor 36 or the digital signal processor 38 may be eliminated, with all signal processing functions being performed by the remaining processor.

It will also be understood that the analog signal processor 36 may be implemented by a number of analog or integrated circuit elements in combination, including comparators, operational amplifiers, and various other devices. The digital signal processor 38 may be implemented using a digital signal processing (DSP) chip, a microcontroller, a microprocessor, an application specific integrated circuit (ASIC) and/or other digital devices. Various such devices may operate under stored program control and the suitable programming of such devices lies within the knowledge of one of ordinary skill in the art having regard to the description herein. Software programs may be stored in a memory element (not shown) associated with the digital device.

Figure 3:
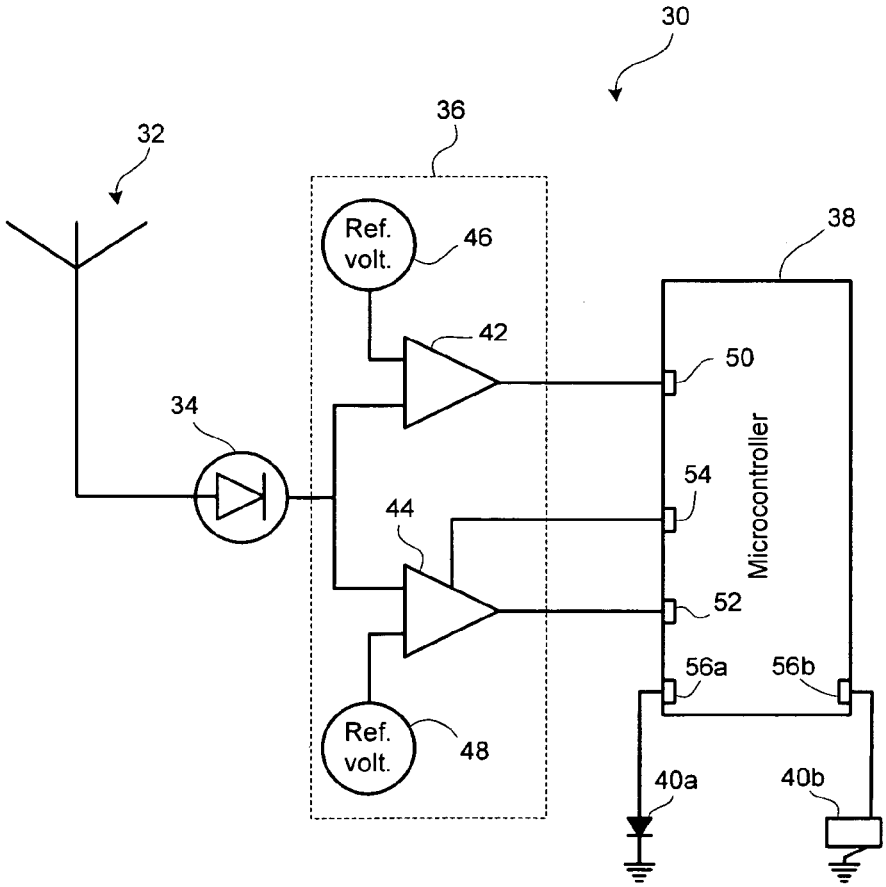
FIG. 3 shows a simplified circuit diagram of an embodiment of the external indicator.

Reference is now made to FIG. 3, which shows a simplified circuit diagram of an embodiment of the external indicator 30. In this embodiment, the external indicator 30 is designed to detect a reader trigger signal. Upon detecting the reader trigger signal, the external indicator 30 is designed to detect a transponder response signal. A detected transponder response signal is analyzed to determine whether it includes predetermined characteristics before it is deemed to be a qualifying transponder response signal.

The analog signal processor 36 includes a first comparator 42 and a second comparator 44. The first comparator 42 assesses whether a received and demodulated signal (i.e. a baseband signal) from the RF detector 34 meets a first threshold level. The first threshold level is established by a first reference voltage 46 which serves as an input to the first comparator 42. The other input to the first comparator 42 is the baseband signal from the RF detector 34. The first reference voltage 46, and thus the first threshold level, is set so as to establish a minimum signal strength for a detected reader trigger signal. If a reader trigger signal does not meet the first threshold level, then the external indicator 30 does not react to it. Once a detected reader trigger signal meets the first threshold level, the first comparator 42 outputs a detection signal. It will be appreciated that when the first comparator 42 receives an input baseband signal having a sufficient signal strength the thresholding operation of the first comparator 42 results in signal shaping so as to output a binary detected signal.

In this embodiment, the digital signal processor 38 comprises a microcontroller or digital circuit having an input port 50, an enable output port 54, and a data input port 52. The binary detected signal output from the first comparator 42 is input to the input port 50, with interrupt capability. The binary detected signal may be digitized and analyzed by the digital signal processor 38 so as to qualify it as a valid reader trigger signal. For example, the digital signal processor 38 may evaluate the duration of the binary detected signal or the pulse pattern of the signal. If the binary detected signal is qualified as a reader trigger signal, then the digital signal processor 38 outputs an enable signal from the enable output port 54.

The enable signal enables or powers the second comparator 44. The second comparator 44 is for detecting receipt of a transponder response signal. The inputs to the second comparator 44 are the demodulated received baseband signal from the RF detector 34 and a second reference voltage 48. The second reference voltage 48 is established to set a minimum signal strength (i.e. a second threshold level) for a received signal to qualify as a detected transponder response signal. Advantageously, the first threshold level for a qualifying trigger signal may be set independently of the second threshold level for a qualifying response signal.

If the baseband signal meets the second threshold level, then the baseband signal is output from the second comparator 44. The output of the second comparator 44 is connected to the data input port 52 of the digital signal processor 38. Accordingly, if signal strength of the baseband signal meets the second threshold level, then it is input to the digital signal processor 38. Again, it will be appreciated that the second comparator 44 performs a binary signal shaping operation to output a binary signal.

The digital signal processor 38 digitizes the binary signal to create a digital received signal and it analyzes whether the digital received signal meets predetermined criteria for qualification as a transponder response signal. The predetermined criteria may, for example, comprise a predefined signal duration, a coding scheme, and/or a predetermined data content. The data content comparison may be based upon the contents of a particular field of data that may be expected to appear in a valid transponder response signal.

The digital signal processor 38 further includes one or more indicator output ports 56 (shown as 56*a* and 56*b*). If the digital received signal qualifies as a transponder response signal, then the digital signal processor 38 outputs an indicator signal on the indicator output ports 56. The output ports 56 are coupled to one or more indicator devices 40 (shown as 40*a* and 40*b*). As shown, in some embodiments, the indicator devices 40 may comprise LEDs 40*a* or a buzzer 40*b*.

It will be understood that the external indicator 30 may include other components for performing other signal processing operations. For example, the external indicator 30 may include filters and other components for signal shaping and conditioning.

Figure 4:
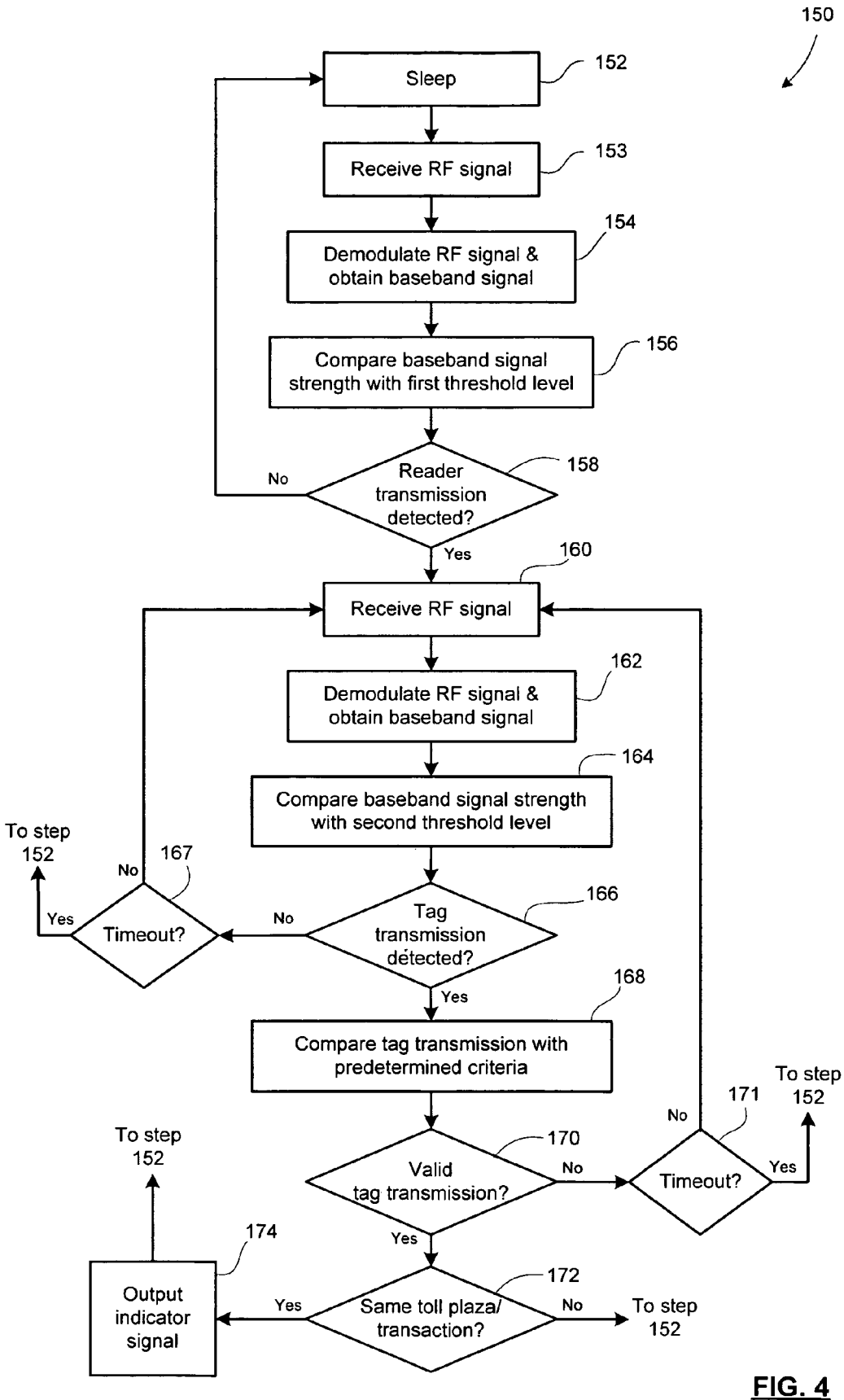
FIG. 4 shows, in flowchart form, a method of signalling detection of an electronic toll collection transaction using an external indicator.

Reference is now made to FIG. 4, which shows, in flowchart form, a method 150 of signalling detection of an electronic toll collection transaction using an external indicator.

The method 150 shown in FIG. 4 is based upon an embodiment wherein a reader transmission is first detected and then a transponder transmission is detected and compared with predetermined criteria. It will be appreciated that other embodiments will involve a variation of the method 150. For example, in some embodiments, the method 150 may involve a comparison of the reader transmission with certain predetermined criteria to verify that a reader trigger signal has been detected.

The method 150 begins in step 152, wherein the external indicator is in its sleep mode. It will be understood by those of ordinary skill in the art that the sleep mode is a mode in which the external indicator shuts off all circuits except the low current RF receiver so as to maintain minimum current consumption.

In step 153 the RF receiver receives an RF signal. In step 154 the RF signal is demodulated to produce a baseband signal. As described above in connection with FIG. 3, the receipt and demodulation of the RF signal may be implemented using an antenna and RF detector. In one embodiment, the modulation scheme is amplitude modulation; however, other types of modulation are included within the scope of the present invention.

In step 156, the baseband signal strength is compared against a first threshold signal level. The first threshold signal level is established to set a minimum signal strength required for the external indicator to deem a received signal to constitute a reader transmission. In step 158, the external indicator assesses whether the baseband signal qualifies as a reader transmission. In some embodiments, this qualification step may constitute simply determining if the signal meets the first threshold level. In other embodiments, the baseband signal may be digitized and assessed against other criteria, such as duration, pattern, etc. If the baseband signal qualifies as a reader trigger signal, then the method 150 continues to step 160. If not, then the method 150 returns to step 152 to return to sleep mode and to continue listening for a reader trigger signal.

Having now received a reader trigger signal, in steps 160 and 162 the external indicator continues to receive and demodulate incoming RF signals. The baseband signal resulting from demodulation is compared against a second threshold to evaluate its signal strength in step 164. The second threshold may be the same as the first threshold or it may be different. Typically, the second threshold will be established at a different level to account for the expected differences in signal strength as between a reader transmission and a tag transmission at the locality of the external indicator. The comparison in step 164 establishes whether the received signal may be deemed a potential transponder response signal.

In step 166, the external indicator assesses whether the baseband signal meets the second threshold level for signal strength and may therefore be deemed a potential transponder response signal. If the second threshold level is met, then the method 150 continues in step 168; otherwise, the method 150 returns to step 160 to continue awaiting receipt of a signal of sufficient strength. The method 150 may include a timeout evaluation step 167 in which the method 150 determines whether a preset duration has elapsed without detection of a potential transponder response signal. If such a duration has elapsed, then the method 150 may revert back to step 152 to re-enter sleep mode and await receipt of another reader trigger signal.

In step 168, the potential transponder response signal, i.e. baseband signal, is evaluated to determine if it is a transponder response signal. In particular, it is evaluated against predetermined criteria indicative of a transponder response signal. In one embodiment, this evaluation comprises digitizing the baseband signal and comparing the digitized signal with a predetermined bit pattern. If the predetermined bit pattern is detected in the digitized signal, then the external indicator may deem the signal to be a transponder response signal in step 170. If the baseband signal does not meet the predetermined criteria, then the method 150 returns to step 160 to continue searching for a transponder response signal. The method 150 may include a timeout evaluation step 171 in which the external indicator assesses whether a predetermined length of time has elapsed without detection of a validated transponder response signal. If so, then the method 150 may return to step 152 to re-enter sleep mode and await a reader trigger signal again.

If a valid transponder transmission is detected in step 170, then in step 172 the external indicator may assess whether the transmission relates to the same transaction. In some embodiments, the external indicator may be designed to output an indicator signal only once per toll plaza, so it may evaluate whether the tag transmission relates to the same toll plaza transaction. It may do this on the basis of comparing a reader ID with the most recently detected reader ID, or comparing the last transaction field in the response signal with the most recently detected last transaction field. Other comparisons or evaluation may be apparent to those of ordinary skill in the art.

If the transponder transmission relates to the same toll plaza or transaction, then from step 172 the method 150 returns to step 152 to re-enter sleep mode and await a new reader trigger signal. Otherwise, the method 150 continues to step 172 wherein the external indicator outputs an indicator signal. The indicator signal triggers the output of a sensory indication, such as a visual, auditory or kinetic stimulus, to alert a vehicle occupant to the detection of a likely ETC transaction. The sensory indication may be output for a predetermined duration; for example, a light may be illuminated for a number of seconds and/or a buzzer or beeper may sound for a preset period or for a preset number of discreet instances.

An ETC system that uses passive (i.e. backscatter) tags presents particular difficulties. The tags operate by receiving a continuous wave RF transmission from the roadside reader. The tags do not broadcast an independent signal. Instead they modulate the continuous wave RF signal by switching the load coupled to the RF antenna on the tag. The resulting modulation is sensed at the antenna of the roadside reader.

The external indicator will receive both the continuous wave signal from the reader and the continuous wave signal as modulated by the transponder. The external indicator may employ a demodulator with baseband filtering capability to obtain the transponder response signal (i.e. the reflected signal).

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An external indicator for use in proximity to an on-board unit of an electronic toll collection system, the electronic toll collection system including a roadside unit for communicating with the on-board unit and conducting an electronic toll collection (ETC) transaction, the on-board unit including an on-board antenna and an on-board transceiver for sending and receiving RF transmissions and an on-board processor for controlling the on-board transceiver and conducting the ETC transaction with the roadside unit, the external indicator comprising:

an RF antenna;

an RF detector coupled to said RF antenna for demodulating an RF signal induced in said RF antenna by an RF transmission and for outputting a demodulated signal;

a processor having an input for receiving said demodulated signal and an output for providing an indicator signal, the processor having a component for determining if said demodulated signal is indicative of an ETC transmission between said on-board unit and said roadside unit and, if so, generating said indicator signal, wherein said component is configured to determine that said demodulated signal is indicative of said ETC transmission by identifying that said demodulated signal comprises a transponder response signal from said on-board unit; and an indicator device coupled to the output of said processor, said indicator device producing a sensory event in response to said indicator signal.

2. The external indicator claimed in claim 1, wherein said processor includes a signal strength component for comparing a signal strength of said demodulated signal with a first threshold level.

3. The external indicator claimed in claim 2, wherein said signal strength component outputs a detection signal if said signal strength of said demodulated signal exceeds said first threshold level, and wherein said component for determining operates in response to said detection signal.

4. The external indicator claimed in claim 2, wherein said signal strength component comprises a first comparator for applying said first threshold level.

5. The external indicator claimed in claim 4, wherein said signal strength component further includes a second comparator for applying a second threshold level, wherein said second comparator outputs said demodulated signal to said component for determining.

6. The external indicator claimed in claim 1, wherein said indicator device comprises at least one visual device, sensory device, or kinetic device.

7. The external indicator claimed in claim 1, wherein said indicator device is selected from the group consisting of a light emitting diode, a speaker, a buzzer, a chime, a vibratory mechanism, an incandescent light, and a display screen.

8. A method of signalling detection of a likely electronic toll collection (ETC) transaction between an on-board unit and a roadside unit, the on-board unit including an on-board antenna and an on-board transceiver for sending and receiving RF transmissions and an on-board processor for controlling the on-board transceiver and conducting the ETC transaction with the roadside unit, the method comprising the steps of:

receiving and demodulating an RF signal to produce a demodulated signal at an external indicator separate from the on-board unit;

determining at the external indicator if the demodulated signal is indicative of an ETC communication between the roadside unit and the on-board unit and, if so, generating an indicator signal, wherein said step of determining includes identifying that said demodulated signal comprises a transponder response signal from said on-board unit; and outputting said indicator signal to an indicator device for producing an sensory event at the external indicator in response to said indicator signal.

9. The method claimed in claim 8, including a step of comparing a signal strength of said demodulated signal with a first threshold level.

10. The method claimed in claim 9, including a step of outputting a detection signal based upon said step of comparing if said signal strength of said demodulated signal exceeds said first threshold level, and wherein said step of determining is performed in response to said detection signal.

11. The method claimed in claim 9, wherein said step of determining includes a second step of comparing the signal strength of said demodulated signal with a second threshold level.

12. The method claimed in claim 8, wherein said indicator device comprises at least one visual device, sensory device, or kinetic device.

13. The method claimed in claim 8, wherein said indicator device is selected from the group consisting of a light emitting diode, a speaker, a buzzer, a chime, a vibratory mechanism, an incandescent light, and a display screen.

14. The external indicator claimed in claim 1, wherein said external indicator excludes an RF transmitter.

15. The external indicator claimed in claim 1, wherein said external indicator has no direct connection with the on-board unit.

16. The method claimed in claim 8, wherein said steps of receiving and determining include (a) receiving a RF signal from the roadside reader, (b) identifying the RF signal from the roadside reader as a reader trigger signal, (c) detecting an RF signal from the on-board reader, and (d) identifying the RF signal from the on-board reader as said transponder response signal.

17. The method claimed in claim 16, wherein said steps of identifying include demodulating and digitizing said RF signals, and comparing said demodulated RF signals with expected characteristics.

18. The method claimed in claim 8, wherein said step of receiving comprises receiving said RF signal inductively via an RF antenna.

* * * * *